US010758090B2

(12) United States Patent
White

(10) Patent No.: US 10,758,090 B2
(45) Date of Patent: Sep. 1, 2020

(54) DRY FLOOR BATH TUB ATTACHMENT

(71) Applicant: William White, Lake Park, GA (US)

(72) Inventor: William White, Lake Park, GA (US)

( * ) Notice: Subject to any disclaimer, the term of this patent is extended or adjusted under 35 U.S.C. 154(b) by 54 days.

(21) Appl. No.: 15/988,663

(22) Filed: May 24, 2018

(65) Prior Publication Data

US 2019/0357731 A1 Nov. 28, 2019

(51) Int. Cl.
*A47K 3/00* (2006.01)
*A47K 3/02* (2006.01)

(52) U.S. Cl.
CPC ..... *A47K 3/001* (2013.01); *A47K 3/02* (2013.01)

(58) Field of Classification Search
CPC ..... A47K 3/001
USPC ..... 4/558, 591, 584
See application file for complete search history.

(56) References Cited

U.S. PATENT DOCUMENTS 6,360,380 B1 * 3/2002 Swart ..... A61H 33/0087 4/541.1
6,591,432 B1 * 7/2003 Feinstein ..... A47K 3/38 160/DIG. 6
2008/0190048 A1 * 8/2008 Kitakado ..... E04F 15/02 52/177

* cited by examiner

*Primary Examiner* — Christine J Skubinna

(57) ABSTRACT

This device when adapted to an ordinary bath tub, converts the tub into a system that prevents spilled water resulting from the process of taking a bath, from spilling onto the bathroom floor. This device captures the water that ordinarily would have fallen on the floor and redirects it to a reservoir tank, for holding. This tank or water holding device, stores the water until it is quickly and easily disposed by dumping it back into the tub's drainage system.

There is no other system that has the ability to keep the bathroom floor completely dry when either taking a shower or a bath. With a series of shield, water trough and hoses, the water that ordinarily would have become a safety hazard on the floor, is quickly channeled off to a drain line, there to a reservoir tank from which the water would be disposed.

The device is attractive, non-intrusive and light weight. It is also detachable after installation and is completely portable and transferrable.

1 Claim, 6 Drawing Sheets

DRY FLOOR BATH TUB ATTACHMENT

INTRODUCTION

Keeping up with hygiene is a good idea, but watch your step. The bathroom is full of ways to hurt yourself—and a new report estimates that nearly a quarter of a million Americans age 15 or older can back that up.

Bathing and showering appear to be particularly dangerous. Overall, about two-thirds of accidental injuries happen in the bathtub or shower—which makes sense, because each can become slippery.

Overall, mishaps near the bathtub, shower, toilet and sink caused an estimated 234,094 nonfatal injuries in the U.S. in 2008 among people at least 15 years old, the Centers for Disease Control and Prevention reported online in its weekly Morbidity and Mortality Weekly Report. They also reported that injury rate rises with age.

Researchers used emergency room data on accidental, nonfatal injuries and some statistical number crunching to reach their conclusions. Their report is full of statistics on slips, sprains, contusions, fractures and concussions that can happen in the bathroom.

While people have long known that the bathroom can be a hazardous area for slips and falls, the new report is the first to quantify how many people suffer injuries in the bathroom and under what circumstances.

Clearly the primary reason bathroom is a hazardous area is because of the slippery of the floor caused by water or condensation. This along with the fact that shoes or some other form of floor gripping materials are not normally worn in the bathroom when taking a bath, this can lend itself to a dangerous slippery situation that often end in injuries.

The primary way water get on the floor in bathrooms is by way of overspills, resulting from the bathing process. This is water that splashes out of the tub and shower area onto the floor. The 'Dry Floor Bath Tub Attachment System' was invented to keep this type water off the floor.

BACKGROUND OF THE INVENTION

The present invention relates generally to the field of home improvement and more specifically to the field and the area of home and hotel bathrooms safety.

It is well known that the bath room can be a dangerous place, especially if the bath room floor is wet. This could be especially precarious if you was a senior or a very young person whose mobility is limited or impaired. Thousands of individuals are injured annually from slip and falls in the bathroom resulting from wet floors. For establishments such as hotels, the liability cost, could mount into the millions.

Currently, individuals are resorting to placing towels or some other water absorbing materials on the floor to reduce the likely hood of a fall. However, these measures are of limited value because they too become inundated with moisture and when stepped on, the moisture attaches to the feet thereby offering very little resistance against slips and falls.

There are other devices and measures being deplored that attempt to address this issue, However, none have proven to be effective and user friendly. Including the technique of placing shower curtains inside the tub. This measure necessitates the cleaning and/or replacement of curtains on a frequent basis because they become soiled.

Therefore there is a need in the industry for a way to keep the bath room floor dry, and to do so without having the user perform cumbersome and difficult measures to achieve those results. This invention, 'The Dry Floor Bath Tub Attachment' satisfies that need and get the job done easily and without effort.

DETAILED DESCRIPTION

The device captures splashing and spilling water resulting from the bathing process and channels it into a holding reservoir. The water in the reservoir is quickly and easily disposed by detaching the reservoir holding unit or tank from the device and dumping the captured water back into the tub.

Shower curtain' bottom end is inserted into the aperture of the device for the purpose of channeling splashing and spilling water into the aperture of the device.

The device is approximately five feet long with an aperture at the top 3 inches wide. The device is 4 inches deep with a ¼ inch slanted tilt at the tip of the side that attaches to the tub. This slant ensures a tight fit against the wall of the tub. The device is an inverted pyramid shape cradle, fully enclosed and sealed. The back side of the device, the side that attaches to the tub, is 4 inches in height with the ¼ inch tilt. The front side is 5 inches high. Both ends of the device are walled in with an inverted pyramid shape sidings. The width of the device at the top is 3 inches but decreases to 2 inches at the base or trough. This narrowing from top to bottom creates this inverted pyramid appearance when viewed from the side.

On the base or trough of the device, approximately 6 inches from the front of the tub; a drain hole ½ inch in diameter is drilled. A stem is inserted in the drain hole so that a drain hose maybe attached. This hose connects the device to a reservoir tank, for the purpose of draining water from the device into a reservoir tank or some other container for disposal.

The device adheres to the surface of the tub by way of suction cups. These cups are spaced evenly the length of the five foot device. Once the device is in place on the tub's side, it could be adjusted either up or down to accommodate the requirements of the installation. The device could also be moved to another bath tub.

The length of the drain hose will vary, but the standard length will be 12 inches. The hose is made of flexible materials which will allow it to bend or fold to meet the need of the installation.

The drain hose is detachable from the device at two locations. The drain hose is detachable at the stem, underneath the device and is also detachable where the hose connects to the reservoir tank.

The reservoir tank has a cap on one end that can be removed to allow the reservoir to be drained. The reservoir tank is approximately two feet in length, with a two inch diameter. The reservoir container does not have to be a tank, it could also be a tube, cylinder, pipe or some other water holding device.

Shower curtains plays an important role in the operation of this device. The curtains are there to block and redirect water that otherwise would land on the floor. Therefore the curtains along with the device form a system that prevents water from falling on the floor.

SUMMARY OF INVENTION

Briefly described, the present invention includes in its most preferred embodiment, a modification to an average bath tub that would redirect water that would have fallen onto the bathroom floor (during the bathing or showering process) back into the tub's drainage system. This modification prevents any water from escaping the environment of the bath tub, thereby greatly enhancing personal safety.

The device extends the length of the tub and is adhered to the tub by suction cups. The device is designed to capture all extemporaneous spilled water that ordinarily would have escaped the environ of the tub & shower enclosure and redirect it to a holding container. The holding container, which could be a jar, pipe, cylinder or some other device; once filled, will allow for the quick and easy disposition of it content.

The unique features of this device includes its' ability to be detached after installment, and transferred to another location. Its' ability to be adjusted in a higher or lower position on the side of the tub, enabling the installer to maximize the effectiveness of the system through the proper depth placement of the curtains bottom inside the aperture of the device.

The device is light weight, durable and easily installed.

Figure 1:
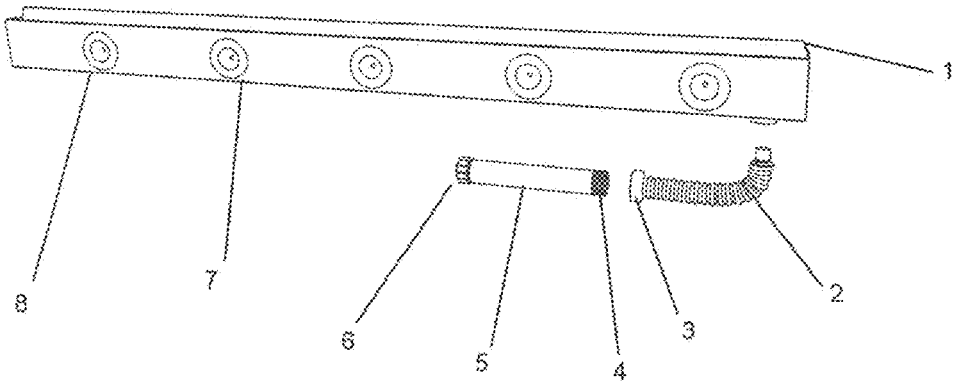
FIG. 1
Figure 2:
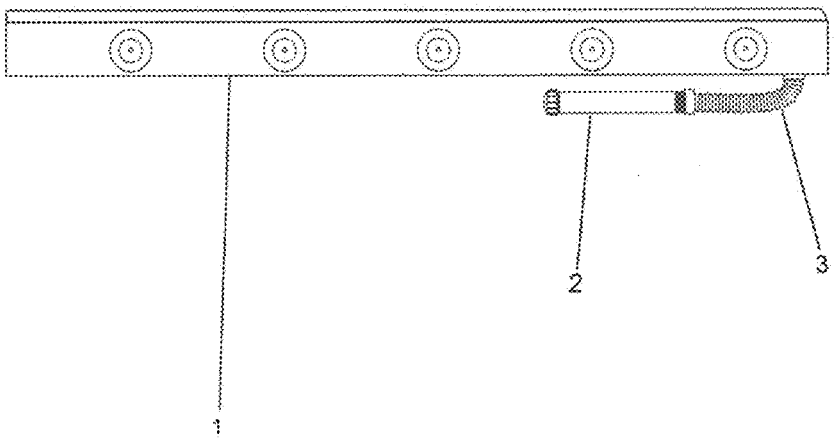
Figure 3:
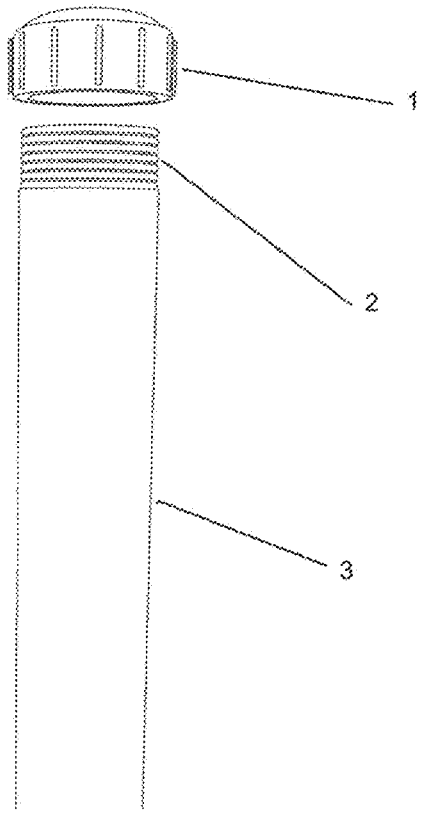
Figure 4:
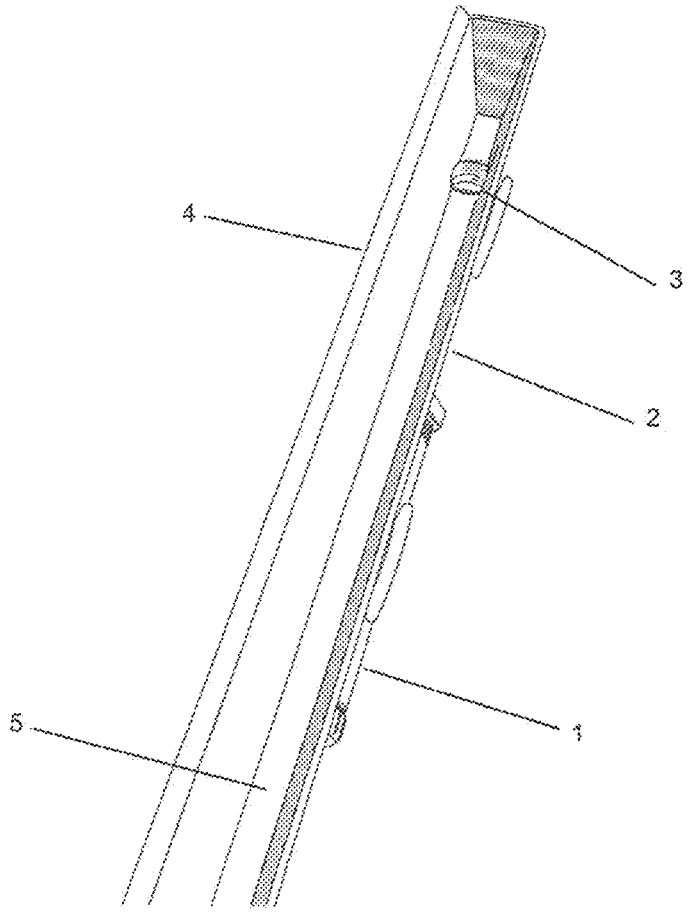
Figure 5:
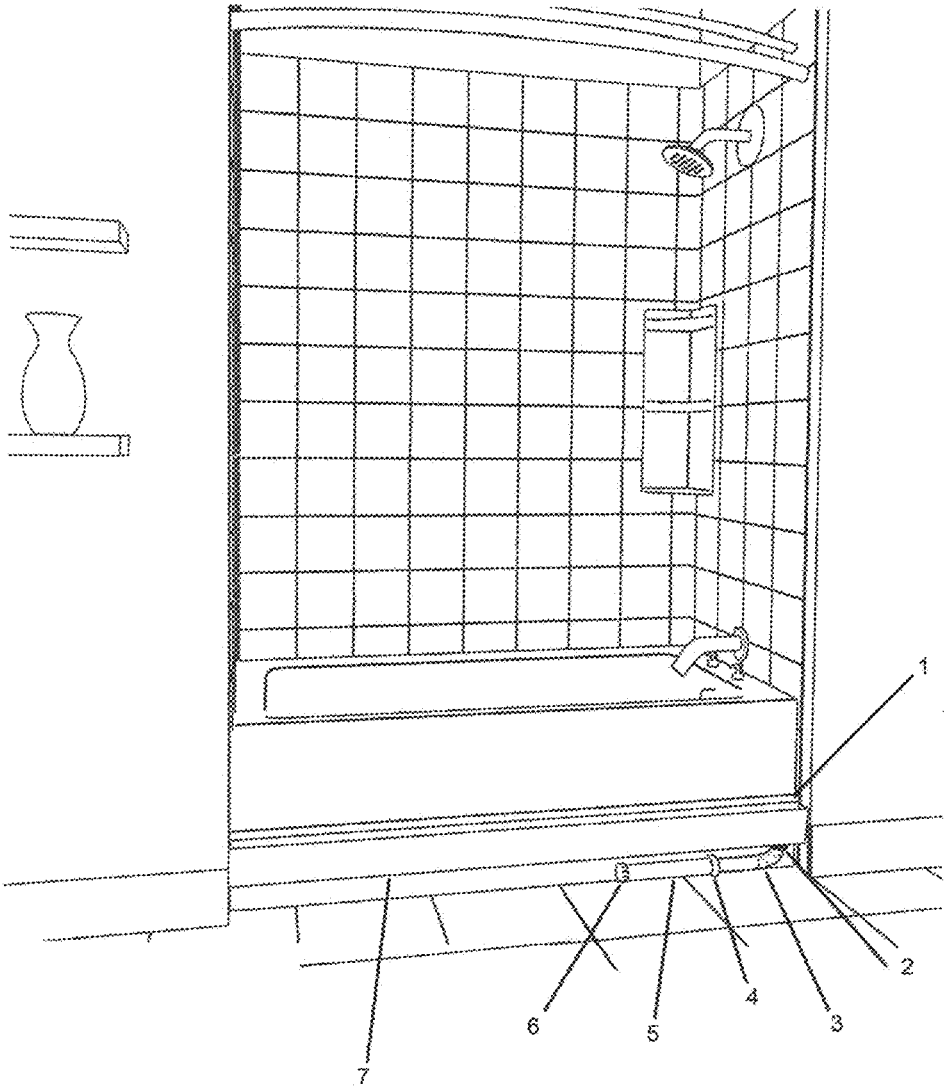
Figure 6:
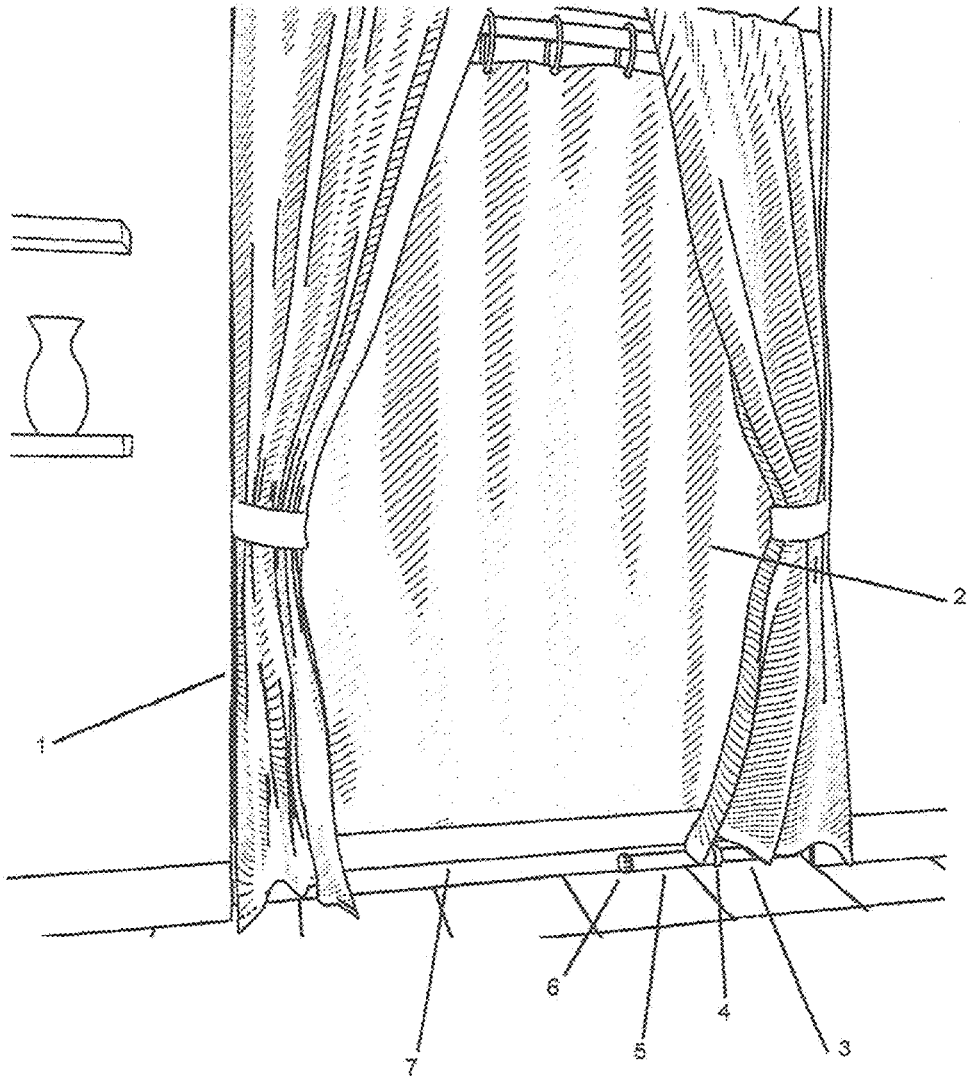

Number 1: Shows the 3 inch aperture or opening of the device. This opening is where the bottom end of the shower curtains will extend into.

Number 2: Shows the flexible drain hose. One end will attach to a stem on the bottom side of the device. The other end will attach to the water reservoir or tank.

Number 3: Shows the connector ring that joins the drain hose to the water tank.

Number 4: Show the grooves at one end of the tank, to be used to connect the drain hose to the tank, by way of the connector ring.

Number 5: This is the reservoir container. The reservoir container could be a tank, a jar, cylinder, pipe or some other water holding container.

Number 6: Shows the screw on cap. This cap when removed, will allow the water inside the container, to drain out.

Number 7: Shows how the suction cups are arranged on the device.

Number 8: Show the body of the device which include the frame and suction cups.

FIG. 2

Number 1: Shows the device complete with all accessories.

Number 2: Shows the tank fully assembled and connected

Number 3: Shows the drain hose, fully connected

FIG. 3

Number 1: Shows a close up of the tank's screw on cap

Number 2: Shows a close p of the grooves

Number 3: Shows the 2 inch diameter body of the tank

FIG. 4

Number 1: Top down view of the device. Shows the water reservoir holding container, partially hidden.

Number 2: Shows the drain hose from a top down view, partially hidden.

Number 3: Shows the ½ inch drain hole, drilled in the trough or base of the device Number 4: Shows ¼ inch tilt on the side of the device that attaches to the tub Number 5: Shows the 2 inch wide trough or base on the device

FIG. 5

Number 1: Shows the 3 inch aperture of the device and how it is attached to the tub.

Number 2: Shows the drain hose connected to the device, frontal view

Number 3: Shows the flexibility in the drain hose

Number 4: Shows a frontal how the connector ring connects the drain hose to the tank.

Number 5: Frontal view of the tank, installed

Number 6: Frontal view of the screw on tank cap

Number 7: Frontal view of the device installed

FIG. 6

Number 1: Bath tub and shower drapes

Number 2: Shower curtains. The view shows the bottom end of the curtains inserted into the aperture of the device Number 3: Shows the flexible drain hose installed Number 4: Shows the connector ring installed Number 5: Shows the water reservoir container installed Number 6: Shows the screw on end cap to the water reservoir container Number 7: Shows the device, the frame, installed with curtains inside

The invention claimed is:

1. An easily removable bathtub splash device consisting of:

a truncated upside down pyramid shaped trough, having a bottom, two sides and two ends; the trough configured for attaching to a bathtub and for insertion of a bottom of a shower curtain therein;

one of the two sides having evenly spaced suction cups, for attaching to the bathtub;

the one of the two sides having a height that is less than a height of a second one of the two sides;

a drain in the bottom and a first end of a detachable flexible hose attached to the drain;

a reservoir attached to a second end of the flexible hose; and a reservoir cap on an end of the reservoir.

* * * * *